US008097570B2

(12) United States Patent
Boitout et al.

(10) Patent No.: US 8,097,570 B2
(45) Date of Patent: Jan. 17, 2012

(54) LUBRICATING COMPOSITION FOR HYDROCARBONATED MIXTURES AND PRODUCTS OBTAINED

(75) Inventors: Nathalie Boitout, Lyons (FR); Laurent Dalix, Saint Just Chaleyssin (FR); Clarisse Doucet, Lyons (FR); Laurent Germanaud, Heyrieux (FR)

(73) Assignee: Total France, Puteaux (FR)

( * ) Notice: Subject to any disclaimer, the term of this patent is extended or adjusted under 35 U.S.C. 154(b) by 363 days.

(21) Appl. No.: 11/917,780

(22) PCT Filed: Jul. 4, 2006

(86) PCT No.: PCT/FR2006/001578

§ 371 (c)(1),
(2), (4) Date: Dec. 17, 2007

(87) PCT Pub. No.: WO2007/006901

PCT Pub. Date: Jan. 18, 2007

(65) Prior Publication Data

US 2008/0184617 A1 Aug. 7, 2008

(30) Foreign Application Priority Data

Jul. 5, 2005 (FR) ..... 05 07128

(51) Int. Cl.
*C10M 111/02* (2006.01)
*C10M 169/04* (2006.01)
*A01N 47/48* (2006.01)

(52) U.S. Cl. ..... 508/489; 44/385; 44/386

(58) Field of Classification Search ..... 508/489; 44/385, 386

See application file for complete search history.

(56) References Cited

U.S. PATENT DOCUMENTS

| | | | | |
|---|---|---|---|---|
| 2,522,889 | A | 9/1950 | Peters | |
| 4,032,303 | A | 6/1977 | Dorer, Jr. et al. | |
| 4,185,594 | A | 1/1980 | Perilstein | |
| 4,204,481 | A | 5/1980 | Malec | |
| 4,208,190 | A | 6/1980 | Malec | |
| 4,248,182 | A | 2/1981 | Malec | |
| 4,448,586 | A | 5/1984 | Weidig | |
| 4,609,376 | A * | 9/1986 | Craig et al. | 44/397 |
| 6,592,639 | B2 | 7/2003 | Bernasconi et al. | |
| 2004/0118033 | A1 * | 6/2004 | Wilkes et al. | 44/385 |

FOREIGN PATENT DOCUMENTS

| | | | |
|---|---|---|---|
| CA | 2112732 | | 7/1994 |
| EP | 0605857 | A1 | 7/1994 |
| EP | 0635558 | A1 | 1/1995 |
| EP | 1310547 | A1 | 5/2003 |
| EP | 1340801 | A1 | 9/2003 |
| WO | 97/45507 | A1 | 12/1997 |
| WO | 98/04656 | A1 | 2/1998 |
| WO | 01/88064 | A2 | 11/2001 |
| WO | 02/02720 | A2 | 1/2002 |

* cited by examiner

*Primary Examiner* — Walter D Griffin
*Assistant Examiner* — Francis C Campanell
(74) *Attorney, Agent, or Firm* — Lesley S. Craig

(57) ABSTRACT

A subject of the present invention is an anti-corrosive and antistatic lubricating composition for a hydrocarbonated mixture comprising:

a) at least a compound A of Formula (I) below:

(I)

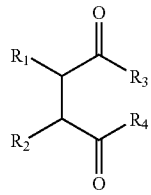

in which $R_1$ and $R_2$ are hydrogen or a linear or branched alkyl group of 1-40 carbon atoms, comprising possibly one to five double bond(s), $R_1$ and $R_2$ together being able to form an aromatic or aliphatic ring of 5-6 carbon atoms, said ring being capable of substitution by one to three linear or branched alkyl group(s) of 1-40 carbon atoms, in which $R_1$ and $R_2$ cannot be hydrogen at the same time, and in which $R_3$ and $R_4$, identical or different, are chosen from the OH groups, in which $R_3$ and $R_4$ cannot be the OH group at the same time, or deriving from a linear or branched monol or polyol group containing 1-20 carbon atoms having a functionality of 2 to 5 inclusive;

b) and at least one B compound corresponding to a fatty acid of 16-24 carbon atoms, unsaturated or not, optionally in a mixture with a carboxylic acid comprising at least one aromatic and/or olefinic polycycle or ring and/or their ester, amide or corresponding amine salts derivatives, taken alone or in a mixture.

39 Claims, No Drawings

LUBRICATING COMPOSITION FOR HYDROCARBONATED MIXTURES AND PRODUCTS OBTAINED

The present invention relates to a composition for hydrocarbonated mixtures, in particular with a low sulphur content, intended to improve their lubricity, but also concomitantly limit their corrosive character vis à vis metal parts with which they are brought into contact and increase their antistatic character by raising their conductivity. A composition of this type is applicable to any hydrocarbonated mixture, entirely or partially synthetic, capable of providing the energy required for moving land vehicles or aircraft, more particularly diesel fuel, kerosene or gasoline for internal combustion engines, these hydrocarbons having a low sulphur content of less than 500 ppm, below 50 ppm and even below 10 ppm.

Whatever the hydrocarbonated mixture usable as an energy source for moving these vehicles, it is well known that it must have lubrication capabilities for protecting the pumps, injection systems and all the moving parts with which these mixtures can come into contact. As regulations in many countries have imposed an upper limit on the acceptable sulphur content of fuels of less than 0.05% by weight, then less than 50 ppm and even less than 10 ppm in order to reduce the emissions of pollutants from cars, lorries or buses, in particular in built-up urban areas, the refinery industry has increasingly been led to improve its treatment processes for the removal of sulphur compounds. Increasingly, fuels have become clean and non-polluting products, free from sulphur and the often associated aromatic and polar compounds. However, all these compounds gave the fuels their lubricity. Other negative effects have arisen concomitantly with the loss of the lubricating character, such as increased problems of static electricity, in particular during all the operations of handling hydrocarbons but also during storage. It has thus become necessary to replace these compounds which confer a lubricating character on hydrocarbons, whether distilled or not, with other compounds which do not pollute the environment but have a sufficient lubricating power to avoid the risks of engine wear, and also to mitigate the harmful effects of static electricity and corrosion which are inherent in gas oils.

The prior art includes many solutions to improve the lubricity and/or the corrosion or the lubricity and/or the antistatic effect of additives, but no document has sought to solve the problems of lubricity as a whole, while still limiting the corrosion and the conductivity of the hydrocarbons used in engines, maintaining and even reducing the levels of additives incorporated for an equal efficiency.

In order to improve the lubricity of a fuel, whether gasoline, kerosene or gas oil, several types of additives have already been proposed. These are primarily anti-wear additives, known in the field of lubricants, of the following types, unsaturated fatty acid esters and dimeric fatty acids, aliphatic amines, fatty-acid and diethanolamine esters and long-chain aliphatic monocarboxylic acids as described in U.S. Pat. Nos. 2,252,889, U.S. Pat. No. 2,522,889, U.S. Pat. No. 4,185,594, U.S. Pat. No. 4,204,481, U.S. Pat. No. 4,208,190, U.S. Pat. No. 4,248,182. Most of these additives have a sufficient lubricating capability, but at concentrations that are certainly too high, which is very disadvantageous in economic terms. Moreover, the additives containing dimeric acids cannot be used in high concentrations in fuels supplying vehicles in which the fuel can be in contact with the lubricating oil, as these acids react chemically to form deposits which are sometimes insoluble in oil, but are primarily incompatible with the detergent additives customarily used.

U.S. Pat. No. 4,609,376 advocates the use of anti-wear additives obtained from esters of mono- and polycarboxylic acids and polyhydroxyl alcohols in fuels containing alcohols in their composition.

Another route of choice is to introduce vegetable oil esters or the vegetable oils themselves into these fuels to improve their lubricity or their smoothness. These include the esters derived from rapeseed, flax, soya, sunflower oils or the oils themselves (see patents EP 635,558 and EP 605,857). One of the major drawbacks of these esters is their low lubricating capability at a concentration of less than 0.5% by weight in the fuels.

To solve these problems, the Applicant has proposed to introduce into fuels with low sulphur contents, below 500 ppm, compositions obtained by mixing fatty monocarboxylic acids and polyaromatic monocarboxylic acids, preferably of vegetable origin, in the form of acids, esters or amine salts (EP 915944, EP 1310547 and EP 1340801).

Industrial producers currently seek to improve lubricity and conductivity or the lubricity and corrosion properties, by using a selection of mixtures which can be introduced into hydrocarbons at reasonable rates and have an efficiency identical to, if not better than, that of the products previously used on their own but sometimes at much higher concentrations.

Thus, to improve lubricity and limit the risks of accumulation of static electricity during the production, handling and use of hydrocarbons with low sulphur contents, below 500 ppm, application WO 01/88064 claims a fuel composition comprising a liquid fuel containing less than 500 ppm sulphur, 0.001 to 1 ppm of at least one monoamine or an N-substituted polyamine and 10 to 500 ppm of at least one fatty acid containing 8 to 24 carbon atoms or its equivalent ester with an alcohol or polyalcohol of at most of eight carbon atoms.

To improve lubricity, application WO 97/45507 proposes to introduce into the hydrocarbons, compounds of the type derived from esterified alkenyl anhydrides, in proportions varying from 5-5000 ppm. The applicants found that by adding certain of these compounds, the anti-corrosive properties of these fuels were greatly improved.

Notwithstanding these improvements, an aim of the present invention is to simultaneously improve the lubricity and the antistatic and anticorrosive properties of hydrocarbonated mixtures with low sulphur contents, while still limiting their quantity with an equal efficiency. It aims more particularly to improve the characteristics of the fuels, gasoline, gas oil and kerosenes with low sulphur contents, whether in the form of an emulsion in water or not, and even of certain lubricants.

A subject of the present invention is a lubricating, anticorrosive and antistatic composition for a hydrocarbonated mixture comprising:

a) at least a compound A of Formula (I) below:

(I)

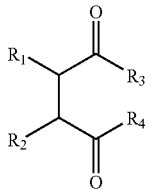

in which $R_1$ and $R_2$ are hydrogen or a linear or branched alkyl group of 1-40 carbon atoms, possibly comprising at least one double bond, $R_1$ and $R_2$ together being able to form an aromatic or aliphatic ring of 5-6 carbon atoms, said ring being capable of substitution by one to three linear or branched alkyl group(s) of 1-40 carbon atoms, in which $R_1$ and $R_2$ cannot be hydrogen at the same time, and in which $R_3$ and R4, identical or different, are chosen from the OH groups, wherein $R_3$ and $R_4$ cannot be the OH group at the same time, or deriving from a linear or branched monol or polyol group containing 1-20 carbon atoms having a functionality of 2 to 5 inclusive;

b) and at least one B compound corresponding to a fatty acid of 16-24 carbon atoms, unsaturated or not, possibly in a mixture with a carboxylic acid comprising at least aromatic and/or olefinic polycycle or ring and/or their ester, amide or corresponding amine salts derivatives, taken alone or in a mixture.

Notwithstanding the inherent effects of the compounds A or B, it was noted that the combination of these compounds unexpectedly improved the lubricity of the hydrocarbonated mixtures which contained them, but also increased their conductivity, while still reducing their corrosivity vis-à-vis the metal parts with which these mixtures were able to be placed in contact. Moreover, it was noted that this composition was compatible with all the hydrocarbonated mixtures which can be used as a fuel and/or a lubricant, required for the propulsion of land vehicles or aircraft.

In order to have an optimum efficiency with regard to lubricity, anti-corrosive effect and antistatic effect in the hydrocarbonated mixtures, the composition of additives according to the invention will preferably comprise from 40 to 70% by weight of at least a compound A and from 60 to 30% by weight of at least a compound B.

This efficiency can be improved if this composition also comprises at least 0.1% by weight of a compound C chosen from the $C_5$-$C_{30}$ mono- and/or polycarboxylic acid esters. The addition of such esters to the concentrations of the invention makes it possible to improve the viscosity of the mixture of additives which can thus be better dispersed in the hydrocarbonated mixture.

In a preferred version of the invention, the composition comprises from 40 to 70% by weight of at least a compound A, from 60 to 30% of at least a compound B and from 0.1 to 20% of at least a compound C. This composition will be even more effective in terms of antistatic and lubricating efficiency if it comprises from 30 to 60% by weight of at least a compound A, from 60 to 30% of at least a compound B and from 5 to 20% of at least a compound C.

In order to achieve this efficiency, the compounds A, B and C will be described more precisely below by defining the radicals $R_1$ and $R_2$, and $R_3$ and $R_4$.

Thus, the compounds A will be described in relation to the radicals $R_1$ and $R_2$ on the one hand, and $R_3$ and $R_4$ on the other hand. Any compound exhibiting any one of these characteristics will be considered as forming part of the compounds A of the invention.

In the compounds A of formula (I), the radicals $R_1$ and $R_2$ can be identical or different. In a first version, $R_1$ is an alkenyl group of 1-22 carbon atoms, and $R_2$ is hydrogen or vice-versa.

In a second version, $R_1$ and $R_2$ together form a ring with 5 or 6 aromatic or aliphatic carbons, possibly substituted by one to three alkyl group(s) of 1-3 carbons.

For each of these possibilities for the radicals $R_1$ and $R_2$ defined above, the radicals $R_3$ and $R_4$ of compound A of Formula (I) can also vary.

In a first scenario, $R_3$ and $R_4$, identical or different, are $OR_5$ with $R_5$ a group chosen from —$[(CH_2)_n—O]_m$—H with n varying from 1-4 and m varying from 1-5; —$[CH_2—CHOH]_p—CH_2—OH$, with p varying from 1-3; —$CH_2—CR_6R_7—OH$, with $R_6$ and $R_7$ which can each be hydrogen, a methyl radical or a —$CH_2OH$ radical.

In a second scenario, $R_3$ is $OR_5$ with $R_5$ a $C_1$-$C_{10}$ linear or branched alkyl group, possibly substituted by at least one OH group, and $R_4$ is OH or vice-versa.

In a third scenario, $R_3$ and $R_4$ are identical or different $OR_5$ groups, with $R_4$ a $C_1$-$C_{10}$ linear or branched alkyl group, possibly substituted by at least one OH group.

In a fourth scenario, $R_3$ is OH or an $OR_5$ group with $R_5$ a $C_1$-$C_{10}$ linear or branched alkyl group, possibly substituted by at least one OH group, and $R_4$ is $OR_5$ with $R_5$ a —$[(CH_2)_n—O]_m$—H group with n varying from 1-4 and m varying from 1-5; —$[CH_2—CHOH]_p—CH_2—OH$, with p varying from 1-3; —$CH_2—CR_6R_7—OH$, with $R_6$ and $R_7$ which can each be hydrogen, a methyl radical or a —$CH_2OH$ radical.

Preferably, the $OR_5$ groups are the groups —O—$CH_2$—$CH_2$—OH or —O—$CH_2$—CHOH—$CH_2$—OH or —O—$CH_2$—$C(CH_3)(CH_2OH)$—$CH_2$—OH or —O—$CH_2$—$C(CH_2OH)$—$(CH_2OH)$—$CH_2$—OH.

Of course, the scope of the invention would not be exceeded if mixtures of compounds A were used.

In parallel, the compound B required for the invention is preferably chosen as comprising at least one linear saturated or unsaturated carboxylic acid comprising 10-24 atoms and/or their esters, amides or amine salts derivatives. Among these acids, oleic, linoleic, linolenic, palmitic, stearic, isostearic and lauric acids are preferred, as well as their esters, amides and amine salts derivatives, taken alone or in a mixture.

More precisely, the majority of compound B will comprise a mixture of oleic acid and linoleic acid, and/or their esters, amides and amine salts derivatives. Preferably, compound B will comprise a mixture of linear fatty acids of vegetable origin, rape, ricin, sunflower, maize, copra, pine or flax, and/or their esters, amides or amine salts derivatives, these products generally being commercial products.

Compound B will preferentially be constituted by a mixture of linear fatty acids originating from the distillation of the pine oils and/or their esters, amides or amine salts derivatives, regardless of their origins.

In another embodiment of the invention, compound B could comprise resin acids, including abietic acid, dihydroabietic acid, tetrahydroabietic acid, dehydroabietic acid, neoabietic acid, pimaric acid, levopimaric acid and parastinic acid, and/or their esters, amides or amine salts derivatives.

In this latter scenario, compound B is constituted by a mixture of fatty acids and resin acids corresponding to a heavier distillate of the distillation of oil of vegetable origin. The distillates obtained by distillation of pine oil and/or their esters, amides or amine salts derivatives are preferred.

Compound C, when it is added to the composition, is a vegetable oil ester from the group constituted by rapeseed, ricin, sunflower, maize, copra, pine or flax oil, the methyl ester of rapeseed being preferred.

A second subject of the invention is a hydrocarbonated mixture with a low sulphur content below 50 ppm, which can be used as a fuel and/or a lubricant required for the movement of land vehicles or aircraft, this mixture comprising at least 50 ppm of the lubricating composition, having additional antistatic and anti-corrosive properties, containing the compounds A and B, and optionally C. The composition gives particularly good performance for hydrocarbonated mixtures having a sulphur content below 10 ppm.

A hydrocarbonated mixture according to the invention will advantageously comprise between 50 and 350 ppm of said composition. This hydrocarbonated mixture is constituted mostly of hydrocarbons originating from the distillation of crude oil, a gasoline, a gas oil, a kerosene or a lubricant, optionally in a mixture with biofuels and/or synthetic fuels originating from the treatment of the gas, this mixture being able to form a stable emulsion in water. By biofuels is meant all essentially hydrocarbonated products originating from the processing of plants, in particular compounds such as compound C, the concentration of which can vary from 0.5 to 100% by weight in the hydrocarbonated mixture. Among synthetic fuels are included the fuels and lubricants obtained by any method of treatment of the gas, in particular by distillation of the products originating from this treatment.

More particularly, the invention relates to hydrocarbonated mixtures, in particular comprising from 50 to 350 ppm of the composition according to the invention, which are:

- a gasoline comprising at least one additive chosen from the group consisting of anti-knock, antifreeze, detergent, de-emulsifying, antioxidant, friction modifying, deposit reduction additives and their mixtures;
- a diesel fuel comprising at least one additive chosen from the group consisting of filterability, anti-foam, detergent, de-emulsifying additives, procetane and their mixtures;
- a domestic heating oil comprising at least one additive chosen from the group consisting of combustion-promoting additives, low-temperature resistance additives, flow, anti-corrosion, antioxidant, biocide, reodorant additives and their mixtures;
- kerosene comprising at least one additive chosen from the group consisting of anti-static, antioxidant additives and their mixtures;
- lubricant comprising at least one additive chosen from the group consisting of dispersant, de-emulsifiying, detergent, anti-foam, antioxidant, low temperature resistance for improving in particular the flow point, reodorant additives and their mixtures.

The advantages of this composition in a hydrocarbonated mixture in its different applications are described in the examples below, these results being given only for the purposes of illustrating the invention and not limiting it.

EXAMPLE I

The present example describes the preparation of different compounds A according to the invention.

The reaction consists of a mono- or di-esterification of the anhydride function with a polyol or mono alcohol without a catalyst, according to the reagents used.

Thus, an alkylated diacid compound in an acid or anhydride form can be reacted with an alcohol or polyol in a tetracol reactor equipped with an ascending coolant, a thermometer, a dropping funnel and a nitrogen intake.

By means of a dropping funnel and accompanied by mechanical stirring, the alcohol or the polyol is poured dropwise onto the previously heated acid or the anhydride and kept at 70° C.

At the end of the addition, the sample is brought to the reflux temperature of the alcohol. The reactor is kept at this temperature and under nitrogen sweeping for a period of approximately five hours.

At the end of the reaction, the compound A thus obtained is distilled under vacuum in order to eliminate the water produced and/or the excess alcohol.

Different compounds A were prepared. The products obtained by reaction of polyol are in the form of diesters. The products obtained by reaction of mono alcohol are in the form of hemiesters. The compounds A are listed in Table 1 below.

TABLE I

| Product | Anhydride | Alcohol | Anhydride/ alcohol ratio |
|---|---|---|---|
| A1 | ODSA | Ethylene glycol | 1:3 |
| A2 | ODSA | Ethanol | 1:2 |
| A4 | ODSA | Butanol | 1:2 |
| A6 | ODSA | Step 1: ethanol | 1:2 |
| | | Step 2: ethylene glycol | 1:2 |
| A7 | ODSA | Ethanol/ | 1:2 |
| | | Diethylene glycol - 50/50 | 1:3 |
| A8 | OSA | Ethylene glycol | 1:3 |

ODSA = octadecenyl succinic anhydride

OSA = octenyl succinic anhydride

EXAMPLE II

The purpose of the present example is to describe the lubricity performance values of the compounds $A_i$ in a mixture with a compound $B_i$ according to the invention, then in a mixture with a third compound $C_i$.

All the additive tests were carried out in two types of gas oils $GO_1$ and $GO_2$, the caracteristics of which are given in Table II below.

TABLE II

| Characteristics | GO1 | GO2 |
|---|---|---|
| MV15 (kg/m3) | 818.4 | 835.4 |
| Sulphur content (mg/kg) | 8 | 6 |
| Viscosity 40° C. (mm2/s) | 2.13 | 2.45 |
| Monoaromatics content | 19.5 | 25.5 |
| Diaromatics content | 1.7 | 2.3 |
| Polyaromatics content | 0 | 0.1 |
| ASTM D86 | | |
| Initial boiling point ° C. | 168.2 | 178.2 |
| Point 5% v | 190.2 | 198.7 |
| Point 10% v | 196.8 | 204 |
| Point 20% v | 210.7 | 216.2 |
| Point 30% v | 223.6 | 228.6 |
| Point 40% v | 235.8 | 241.5 |
| Point 50% v | 247 | 255 |
| Point 60% v | 257.6 | 268.2 |
| Point 70% v | 269.1 | 282.1 |
| Point 80% v | 282.7 | 299.4 |
| Point 90% v | 303.1 | 325.9 |
| Point 95% v | 320.4 | 348.9 |
| Final boiling point | 335.7 | 352.5 |
| V.distillate | 98.5 mL | 96.8 mL |
| Residue | 1.4 mL | 2.8 mL |
| Losses | 0.1 mL | 0.4 mL |

Among the compounds $B_i$ of the invention, $B_1$ is a mixture of long-chain fatty acids containing 2% of a mixture of resin acids derived from pine oil, commonly known as tail oil fatty acid.

The lubricity of the $A_i/B_i$ mixtures was tested in two different gas oils, $GO_1$ and $GO_2$ according to standard ISO 12156-1 for each concentration in the gas oil of 100, 150 and 200 ppm.

The results showing the efficiency of the compounds $A_i$ and $B_1$ are given in Table III below.

TABLE III

| Compound or mixture | 100 ppm | 150 ppm | 200 ppm |
|---|---|---|---|
| | GO1 | | |
| B1 | 445 μm | 427 μm | 407 μm |
| A1 (75%-wt in Solvarex 10) | 609 μm | 472 μm | 394 μm |
| B1/A1 - 80/20 | 496 μm | 439 μm | 410 μm |
| B1/A1 - 60/40 | 504 μm | 399 μm | 363 μm |
| B1/A1 - 50/50 | 458 μm | 392 μm | 361 μm |
| B1/A1 - 45/55 | 407 μm | 330 μm | 299 μm |
| B1/A1 - 40/60 | 515 μm | 364 μm | 322 μm |
| B1/A1 - 35/65 | 416 μm | 306 μm | 286 μm |
| B1/A1 - 30/70 | 384 μm | 318 μm | 325 μm |
| | GO2 | | |
| B1 | 454 μm | 428 4 μm | 426 μm |
| B1/A1 - 50/50 | 336 μm | 36 μm | 249 μm |

As $A_1$ is solid at ambient temperature, it is placed in an oven at 60° C. before formulation. For proportions above 50% of $A_1$, it is necessary to place the mixture for a few minutes in the oven at 60° C. in order to homogenize it.

Thus, the maximum level of $A_1$ in $B_1$ is limited by the state of the mixture at ambient temperature. In fact it seems that the maximum acceptable level of $A_1$ for a binary mixture which is liquid at ambient temperature is comprised between 80% (pasty mixture) and 60% (fluid but viscous).

Nevertheless, the results of Table III show a good lubricity efficiency of the mixtures $A_1/B_1$.

The best results are obtained with 50/50 $A_1/B_1$ mixtures the best compromise between the HFRR efficiency and the homogenization ability of the mixture.

However, in order to improve the viscosity of the mixture $A_1/B_1$, a compound $C_1$ was introduced into these compositions.

The lubricity of the mixtures $A_i/B_i/C_i$ was tested in a gas oil $GO_1$ for a concentration in the gas oil of 200 ppm. Among the potential $C_i$s, $C_1$ is a methyl ester of rapeseed or EMC. The results relating to the $A_1/B_1/C_1$ mixtures are given in Table IV below.

TABLE IV

| Mixture | A1 | B1 | C1 | HFRR (μm) | Viscosity 40° C. ($mm^2/s$) |
|---|---|---|---|---|---|
| M1 | 40% | 60% | 0% | 363 μm | 89.65 |
| M2 | 40% | 60% | 0% | 355 μm | 99.54 |
| M3 | 40% | 40% | 20% | 330 μm | 71.28 |
| M4 | 70% | 30% | 0% | 291 μm | 564.14 |
| M5 | 50% | 30% | 20% | 352 μm | 115.96 |
| M6 | 40% | 50% | 10% | 282 μm | 100 |
| M7 | 55% | 45% | 0% | 299 μm | 373.76 |
| M8 | 55% | 45% | 0% | 315 μm | 222.53 |
| M9 | 60% | 30% | 10% | 287 μm | 251.18 |
| M10 | 50% | 40% | 10% | 239 μm | 142.15 |
| M11 | 45% | 50% | 5% | 275 μm | 175 |
| M12 | 60% | 35% | 5% | 280 μm | 288.34 |

The best compromises between viscosity (between 70 and 120 mm2/s at 40° C.) and lubricity (<350 μm) are obtained for the mixtures $M_7$ and $M_{11}$, the viscosity of $M_8$ being insufficient.

EXAMPLE III

The present example aims to illustrate the lubricity efficiency of the other compounds $A_i$ according to the invention, alone or in combination with $B_i$ and $C_1$. Among the other compounds $B_i$, $B_2$ is an ester resulting from the reaction of $B_1$ with glycerol in a ratio 1:1 and $B_3$ is the product of the reaction of $B_1$ with diethanolamine in a ratio 1:1. The results are given in Table V below.

TABLE V

| Compound | 100 ppm | 150 ppm | 200 ppm |
|---|---|---|---|
| | GO1 | | |
| B1 | 445 μm | 427 μm | 407 μm |
| A2 | 595 μm | 409 μm | 438 μm |
| B1/A2 - 50/50 | 455 μm | 403 μm | 327 μm |
| A4 | 560 μm | 488 μm | 374 μm |
| B1/A4 - 50/50 | 457 μm | 426 μm | 327 μm |
| A6 | 581 μm | 494 μm | 313 μm |
| B1/A6 - 50/50 | 476 μm | 379 μm | 340 μm |
| A7 | 595 μm | 553 μm | 330 μm |
| B1/A7 - 50/50 | 555 μm | 468 μm | 345 μm |
| A8 | 537 μm | 525 μm | 333 μm |
| B1/A8 - 50/50 | 415 μm | 420 μm | 287 μm |
| B1/A8/C1 - 42/43/15 | 481 μm | 348 μm | 312 μm |
| B2 | — | — | 320 μm |
| B3 | — | — | 382 μm |
| B2/A2 - 55/45 | — | — | 290 μm |
| B3/A2 - 55/45 | — | — | 310 μm |
| B3/A1/C1 - 42/43/15 | — | — | 379 μm |
| B2/A1/C1 - 42/43/15 | — | — | 380 μm |
| | GO2 | | |
| B1 | 454 μm | 428 μm | 426 μm |
| A2 | 488 μm | 385 μm | 385 μm |
| B1/A2 - 50/50 | 459 μm | 377 μm | 369 μm |

As for $A_1$, a synergic effect is noted between the compounds $B_1$ and $A_i$, the addition of $C_1$ improving the viscosity of the mixture if necessary.

EXAMPLE V

The present example aims to illustrate the significant effect of the mixture $A_i/B_i$ on conductivity and corrosion.

200 ppm of the mixture $A_i/B_i$ is introduced into the gas oil $GO_1$. The conductivity measurements were carried out according to standard ASTM D2624-2, and those for corrosion according to standard ASTM D 655.

The results are given in Tables VI and VII below.

TABLE VI

| Tested products | Conductivity |
|---|---|
| GO1 | 44 pS/m |
| GO1 + 200 ppm A1(75% Solvarex) | 367 pS/m |
| GO1 + 100 ppm A1(75% Solvarex) | 204 pS/m |
| GO1 + 200 ppm B1 | 45 pS/m |
| GO1 + 200 ppm B2 | 47 pS/m |
| GO1 + 200 ppm B3 | 40 pS/m |
| GO1 + 200 ppm C1 | 70 pS/m |
| GO1 + 200 ppm B1/A1 - 50/50 | 163 pS/m |
| GO1 + 200 ppm B1/A1/C1 - 42/43/15 | 145 pS/m |
| GO1 + 200 ppm B2/A1/C1 - 42/43/15 | 104 pS/m |
| GO1 + 200 ppm B3/A1/C1 - 42/43/15 | 182 pS/m |

TABLE VII

| Corrosion Test | Fresh water |
|---|---|
| GO1 | E |
| GO1 + 200 ppm A1 | A |
| GO1 + 200 ppm B1 | A |
| GO1 + 200 ppm B1/A1 - 50/50 | A |

TABLE VII-continued

| Corrosion Test | Fresh water |
|---|---|
| GO1 + 200 ppm B1/A1/C1 - 42/43/15 | A |
| GO1 + 200 ppm B2/A1/C1 - 42/43/15 | A |
| GO1 + 200 ppm B3/A1/C1 - 42/43/15 | A |

E = corroded,
A = no corrosion

Even if there is good conductivity efficiency and no corrosion with $A_1$ alone, the same cannot be said for lubricity (cf. table III of Example II).

On the other hand, the $B_i$s contribute only a low conductivity but a high lubricity.

In order to achieve the aims of the invention, it is therefore necessary to establish the best compromise between $A_i$, $B_i$ and $C_i$, promoting both lubricity and conductivity, with no corrosion. The best compromise is obtained with a ratio $A_1/B_1/C_1$ corresponding to 43/42/15, lubricity ranging from 300 μm to 350 μm.

EXAMPLE VI

The present example aims to illustrate the significant effect of the mixture $A_i/B_i$ on lubricity, conductivity and corrosion in a kerosene containing less than 3000 ppm sulphur The results are given in Table VIII below.

TABLE VIII

| Test | WSIM | Conductivity ASTM D2624 | HFRR (μm) |
|---|---|---|---|
| Kero | 98 | 50 pS/m | 808 μm |
| Kero + A1 (200 ppm) | 99 | 356 pS/m | 440 μm |
| Kero + A1 (100 ppm) | 98 | 2046 pS/m | 660 μm |
| Kero + B1 (200 ppm) | 95 | 56 pS/m | 435 μm |
| Kero + B1 (100 ppm) | | <56 pS/m | 516 μm |
| Kero + A1/B1/C1 - (200 ppm) 42/43/15 | 48 | 164 pS/m | 386 μm |

The effects of the composition according to the invention can also be clearly seen for the kerosenes.

The invention claimed is:

1. A lubricating, anti-corrosive and antistatic composition for hydrocarbon mixtures comprising:

a) at least a compound A of Formula (I) below:

(I)

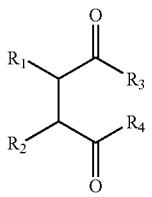

in which $R_1$ and $R_2$ are hydrogen or a linear or branched alkyl group of 1-40 carbon atoms, comprising optionally at least one double bond, $R_1$ and $R_2$ together being able to form an aromatic or aliphatic ring of 5-6 carbon atoms, said ring being capable of substitution by one to three linear or branched alkyl group(s) of 1-40 carbon atoms, in which $R_1$ and $R_2$ cannot be hydrogen at the same time, and in which $R_3$ and $R_4$, identical or different, are chosen from the OH groups, in which $R_3$ and $R_4$ cannot be the OH group simultaneously, or deriving from a linear or branched monol or polyol group containing 1-20 carbon atoms having a functionality of 2 to 5 inclusive;

b) and at least a compound B corresponding to a fatty acid of 16-24 carbon atoms, unsaturated or not, optionally in a mixture with a carboxylic acid comprising at least aromatic and/or olefinic polycycle or ring and/or their ester, amide or corresponding amine salts derivatives, taken alone or in a mixture.

2. Composition according to claim 1, characterized in that the composition comprises from 40 to 70% by weight of at least a compound A and from 60 to 30% by weight of at least a compound B.

3. Composition according to one of claims 1, characterized in that it comprises at least 0.1% by weight of a compound C chosen from $C_5$-$C_{30}$ mono- and/or polycarboxylic acid esters.

4. Composition according to claim 3, characterized in that it comprises from 30 to 70% by weight of at least a compound A, from 60 to 30% of at least a compound B and from 0.1 to 20% of at least a compound C.

5. Composition according to claim 3, characterized in that it comprises from 30 to 60% by weight of at least a compound A, from 60 to 30% of at least a compound B and from 5 to 20% of at least a compound C.

6. Composition according to claim 1, characterized in that, in Formula (I) of compound A, $R_1$ is an alkenyl group of 1-22 carbon atoms, and $R_2$ is hydrogen, or vice-versa.

7. Composition according to claim 1, characterized in that, in Formula (I) of compound A, $R_1$ and $R_2$ together form a ring with 5 or 6 aromatic or aliphatic carbons, optionally substituted by one to three alkyl group(s) of 1-3 carbons.

8. Composition according to claim 1, characterized in that, in Formula (I) of compound A, $R_3$ and $R_4$, identical or different, are $OR_5$ with $R_5$ a group chosen from —$[(CH_2)_n$—O]—H with n varying from 1-4 and m varying from 1-5; —$[CH_2$—CHOH$]_p$—$CH_2$—OH, with p varying from 1-3; —$CH_2$—$CR_6R_7$—OH, with $R_6$ and $R_7$ which can each be hydrogen, a methyl radical or a —$CH_2OH$ radical.

9. Composition according to claim 1, characterized in that, in Formula (I) of compound A, $R_3$ is $OR_5$ with $R_5$ a $C_1$-$C_{10}$ linear or branched alkyl group, possibly substituted by at least one OH group, and $R_4$ is OH or vice-versa.

10. Composition according to claim 1, characterized in that, in Formula (I) of compound A, $R_3$ and $R_4$ are $OR_5$ groups, identical or different, with $R_5$ a $C_1$-$C_{10}$ linear or branched alkyl group, possibly substituted by at least one OH group.

11. Composition according to claim 1, characterized in that, in Formula (I) of compound A, $R_3$ is OH or an $OR_5$ group with $R_5$ a $C_1$-$C_{10}$ linear or branched alkyl group, optionally substituted by at least one OH group, and $R_4$ is $OR_5$ with $R_5$ a —$[(CH_2)_n$—O$]_m$—H group with n varying from 1 to 4 and m varying from 1 to 5; —$[CH_2$—CHOH$]_p$—$CH_2$—OH, with p varying from 1 to 3; —$CH_2$—$CR_6R_7$—OH, with $R_6$ and $R_7$ which can each be hydrogen, a methyl radical or a —$CH_2OH$ radical.

12. Composition according to claim 1, characterized in that, in Formula (I) of compound A, the OR5 groups are the groups —O—$CH_2$—$CH_2$—OH or —O—CH2-CHOH—CH2-OH or —O—CH2-C(CH3)(CH2OH)—CH2-OH or —O—CH2-C(CH2OH)(CH2OH)—CH2-OH.

13. Composition according to claim 1, characterized in that compound B comprises at least one saturated or unsaturated linear carboxylic acid comprising 16-24 atoms and/or their esters, amide or amine salts derivatives, taken alone or in a mixture.

14. Composition according to claim 1, characterized in that the majority of compound B comprises a mixture of oleic, linoleic, palmitic, stearic, isostearic and lauric acids and/or their esters, amide or amine salts derivatives, taken alone or in a mixture.

15. Composition according to claim 1, characterized in that compound B comprises a mixture of fatty acids of plant origin, from rapeseed, ricin, sunflower, maize, copra, pine or flax and/or their esters, amide or amine salts derivatives, taken alone or in a mixture.

16. Composition according to claim 1, characterized in that compound B is constituted by a mixture of fatty acids originating from the distillation of pine oils and/or their esters or amine salts derivatives.

17. Composition according to claim 1, characterized in that the compound B comprises resin acids, including abietic acid, dihydroabietic acid, tetrahydroabietic acid, dehydroabietic acid, neoabietic acid, pimaric acid, levopimaric acid and parastinic acid, and/or their esters, amide or amines salt derivatives, taken alone or in a mixture.

18. Composition according to claim 1, characterized in that the compound B is constituted by a mixture of fatty acids and resin acids originating from the distillation of vegetable oil, their esters, amide or amine salts derivatives.

19. Composition according to claim 3, characterized in that the compound C is a vegetable oil ester of rapeseed, ricin, sunflower, maize, copra, pine or flax, preferably methyl ester of rapeseed.

20. Hydrocarbonated mixture comprising at least 50 ppm of a composition according to claim 1.

21. Hydrocarbonated mixture according to claim 20, with a low sulphur content below 50 ppm.

22. Hydrocarbonated mixture according to claim 20, characterized in that it comprises hydrocarbons originating from the distillation of crude oil, gasoline, a gas oil, a kerosene or a lubricant, optionally in a mixture with biofuels and/or synthetic fuels originating from the treatment of the gas, this mixture being able to form a stable emulsion in water.

23. A hydrocarbonated mixture according to claim 20, which is a gasoline comprising at least one additive chosen from the group consisting of anti-knock, antifreeze, detergent, de-emulsifying, antioxidant, friction modifying, deposit reduction additives and their mixtures.

24. A hydrocarbonated mixture according to claim 20, which is a diesel fuel comprising at least one additive chosen from the group consisting of filterability, anti-foam, detergent, de-emulsifying additives, procetane and their mixtures.

25. A hydrocarbonated mixture according to claim 20, which is a domestic heating oil comprising at least one additive chosen from the group consisting of combustion promoting additives, low-temperature resistance additives, flow, anti-corrosion, antioxidant, biocide, reodorant additives and their mixtures.

26. A hydrocarbonated mixture according to claim 20, which is a kerosene comprising at least one additive chosen from the group consisting of anti-static and antioxidant additives and their mixtures.

27. A hydrocarbonated mixture according to claim 20, which is a lubricant comprising at least one additive chosen from the group consisting of dispersant, de-emulsifying, detergent, anti-foam, antioxidant, low-temperature resistance to improve in particular the pour point, reodorant additives and their mixtures.

28. Hydrocarbonated mixture comprising at least 50 ppm of a composition according to claim 19.

29. Hydrocarbonated mixture according to claim 28, with a sulphur content below 50 ppm.

30. Hydrocabonated mixture according to claim 29, comprising from 50 to 350 ppm of the composition.

31. Hydrocabonated mixture according to claim 30, wherein the sulphur content is below 10 ppm.

32. Hydrocabonated mixture according to claim 1 comprising between 50 and 350 ppm of said composition.

33. Hydrocabonated mixture according to claim 20, with a low sulphur content below 10 ppm.

34. A hydrocarbonated mixture comprising the lubricating, anti-corrosive and antistatic composition of claim 1.

35. A hydrocarbonated mixture in the form of a gasoline, comprising:

at least one additive chosen from the group consisting of anti-knock, antifreeze, detergent, de-emulsifying, antioxidant, friction modifying, deposit reduction additives and their mixtures; and the lubricating, anti-corrosive and antistatic composition of claim 1.

36. A hydrocarbonated mixture in the form of a diesel fuel, comprising:

at least one additive chosen from the group consisting of filterability, anti-foam, detergent, de-emulsifying additives, procetane and their mixtures; and the lubricating, anti-corrosive and antistatic composition of claim 1.

37. A hydrocarbonated mixture in the form of a domestic heating oil comprising:

at least one additive chosen from the group consisting of combustion-promoting additives, low-temperature resistance additives, flow, anti-corrosion, antioxidant, biocide, reodorant additives and their mixtures; and the lubricating, anticorrosive and antistatic composition of claim 1.

38. A hydrocarbonated mixture in the form of a kerosene comprising:

at least one additive chosen from the group consisting of anti-static and antioxidant additives and their mixtures; and the lubricating, anticorrosive and antistatic composition of claim 1.

39. A hydrocarbonated mixture in the form of a lubricant comprising:

at least one additive chosen from the group consisting of dispersant, de-emulsifying, detergent, anti-foam, antioxidant, low-temperature resistance to improve in particular the pour point, reodorant additives and their mixtures, and the lubricating, anticorrosive and antistatic composition of claim 1.

* * * * *

UNITED STATES PATENT AND TRADEMARK OFFICE

CERTIFICATE OF CORRECTION

PATENT NO. : 8,097,570 B2
APPLICATION NO. : 11/917780
DATED : January 17, 2012
INVENTOR(S) : Boitout et al.

It is certified that error appears in the above-identified patent and that said Letters Patent is hereby corrected as shown below:

Column 5, line 33, delete “de-emulsifiying” and insert therefor --de-emulsifying--.
Column 6, line 30, delete “caracteristics” and insert therefor --characteristics--.
Column 10, line 36, delete “O]—H” and insert --O].sub.m—H--.

Signed and Sealed this
Seventeenth Day of April, 2012

David J. Kappos

David J. Kappos
*Director of the United States Patent and Trademark Office*